US006161777A

United States Patent [19]

Carter et al.

[11] Patent Number: 6,161,777

[45] Date of Patent: Dec. 19, 2000

[54] PORTABLE SPRAYING AND DRINKING APPARATUS

[75] Inventors: C. Michael Carter, 709 Coachlight, Hazelwood, Mo. 63042; Donald Freed, Belleville, Ill.

[73] Assignee: C. Michael Carter, Hazelwood, Mo.

[21] Appl. No.: 09/130,771

[22] Filed: Aug. 7, 1998

Related U.S. Application Data

[60] Provisional application No. 60/055,298, Aug. 8, 1997.

[51] Int. Cl.[7] ..... B05B 3/02

[52] U.S. Cl. ..... 239/222.11; 239/33; 239/289; 222/129; 222/380

[58] Field of Search ..... 239/222.11, 261, 239/289, 379, 215, 351, 33; 261/28, 30; 62/311; 416/63, 240; 222/143, 129, 321.1, 321.7–321.9, 482, 331, 380, 383.1

[56] References Cited

U.S. PATENT DOCUMENTS

| | | | |
|---|---|---|---|
| 2,079,117 | 5/1937 | Hays | 261/30 |
| 2,144,860 | 1/1939 | Thorp | 416/240 |
| 3,004,403 | 10/1961 | Laporte | 62/311 |
| 3,997,115 | 12/1976 | Licudine | 239/351 |
| 4,235,377 | 11/1980 | Davis et al. | 239/215 |
| 4,392,614 | 7/1983 | Groth et al. | 239/215 |
| 4,839,106 | 6/1989 | Steiner | 261/28 |
| 5,207,785 | 5/1993 | Knickerbocker | 222/148 |
| 5,304,035 | 4/1994 | Carter | 416/63 |
| 5,715,999 | 2/1998 | Hsu | 239/289 |
| 5,725,356 | 3/1998 | Carter | 416/240 |
| 5,740,948 | 4/1998 | Chu et al. | 239/289 |
| 5,799,873 | 9/1998 | Lau | 239/33 |
| 5,843,344 | 12/1998 | Junkel et al. | 239/289 |
| 6,010,034 | 1/2000 | Walthers | 222/135 |

*Primary Examiner*—Henry J. Recla
*Assistant Examiner*—Khoa D. Huynh
*Attorney, Agent, or Firm*—Senniger, Powers, Leavitt & Roedel

[57] ABSTRACT

A portable spraying and drinking apparatus with soft fan blades having a spraying apparatus, a drinking apparatus, and at least one container for holding drinking and/or spraying liquids. The spraying apparatus directs a cooling liquid through a nozzle placed in the air stream created by a portable fan. The airflow over wet surfaces increases cooling by speeding evaporation. The apparatus also has a separate drinking container which can be filled with a beverage in order to further hydrate and cool the user. The entire drinking and spraying containers can additionally have an insulating jacket surrounding them to keep the liquids cold.

1 Claim, 13 Drawing Sheets

PORTABLE SPRAYING AND DRINKING APPARATUS

This application claims benefit of Provisional Application No. 60/055,298 filed Aug. 8, 1997.

BACKGROUND OF THE INVENTION

This invention relates generally to a portable spraying and drinking apparatus.

Generally, fans used for personal cooling are designed for static use, i.e., the fan is placed in a desired location and plugged in an electrical outlet. However, a stationary fan, which must be plugged into an electrical outlet, cannot be readily used when outside and moving from place to place such as occurs when visiting an amusement park.

It is known to have battery powered, hand held or otherwise portable, self-contained fans. An example of such a fan is shown in my U.S. Pat. No. 5,304,035, which is incorporated herein by reference. It is also known to provide a hand held fan capable of spraying a cooling mist to enhance the cooling action of the fan through evaporation of moisture sprayed onto the skin. Fans incorporating misting apparatus are shown in U.S. Pat. Nos. 3,997,115 and 4,839,106.

In addition, personal cooling and comfort is enhanced by the consumption of liquids. However, in order to both hold a fan and consume liquid, both hands must be used. One hand must hold the fan while the other holds the drink container. It would be desirable to have a personal cooling device which would also provide a drinking liquid source. Such a design would further promote cooling of the user by helping to replace liquids lost through perspiration.

SUMMARY OF THE INVENTION

Among the several objects and features of the present invention may be noted the provision of a portable spraying and drinking apparatus which efficiently and economically cools and hydrates the user; the provision of such apparatus which is compact and can be carried in one hand; the provision of such apparatus which inhibits injury associated with accidental contact with rotating blades of a fan of the device; the provision of such apparatus which permits easy removal of a hydration unit for use independently of a personal cooling unit; and the provision of such apparatus which permits easy removal of the cooling unit for use independently of the hydration unit.

Portable spraying and drinking apparatus for personal cooling and hydration constructed according to the principles of the present invention generally comprises a liquid container, a liquid spraying device for pumping liquid from the container and spraying the liquid, and a liquid drinking device, for removing liquid from the container for consumption by the user. The liquid spraying and drinking devices are incorporated into a single unit capable of being held in one hand.

In another aspect of the invention, a rotating fan blade assembly generally comprises a hub and a plurality of blades extending radially outward from the hub. The blades each have an airfoil shape for moving air as the blade assembly is rotated. Each blade has a radially inner portion of a rigidity selected to hold the shape of the blade as it is rotated and a peripheral edge portion made of softer and more flexible material than the radially inner portion to inhibit injury upon contact with a human body.

Other objects and features will be in part apparent and in part pointed out hereinafter.

BRIEF DESCRIPTION OF THE DRAWINGS

Corresponding reference characters indicate corresponding parts throughout the several views.

DETAILED DESCRIPTION OF THE PREFERRED EMBODIMENTS

Figure 1:
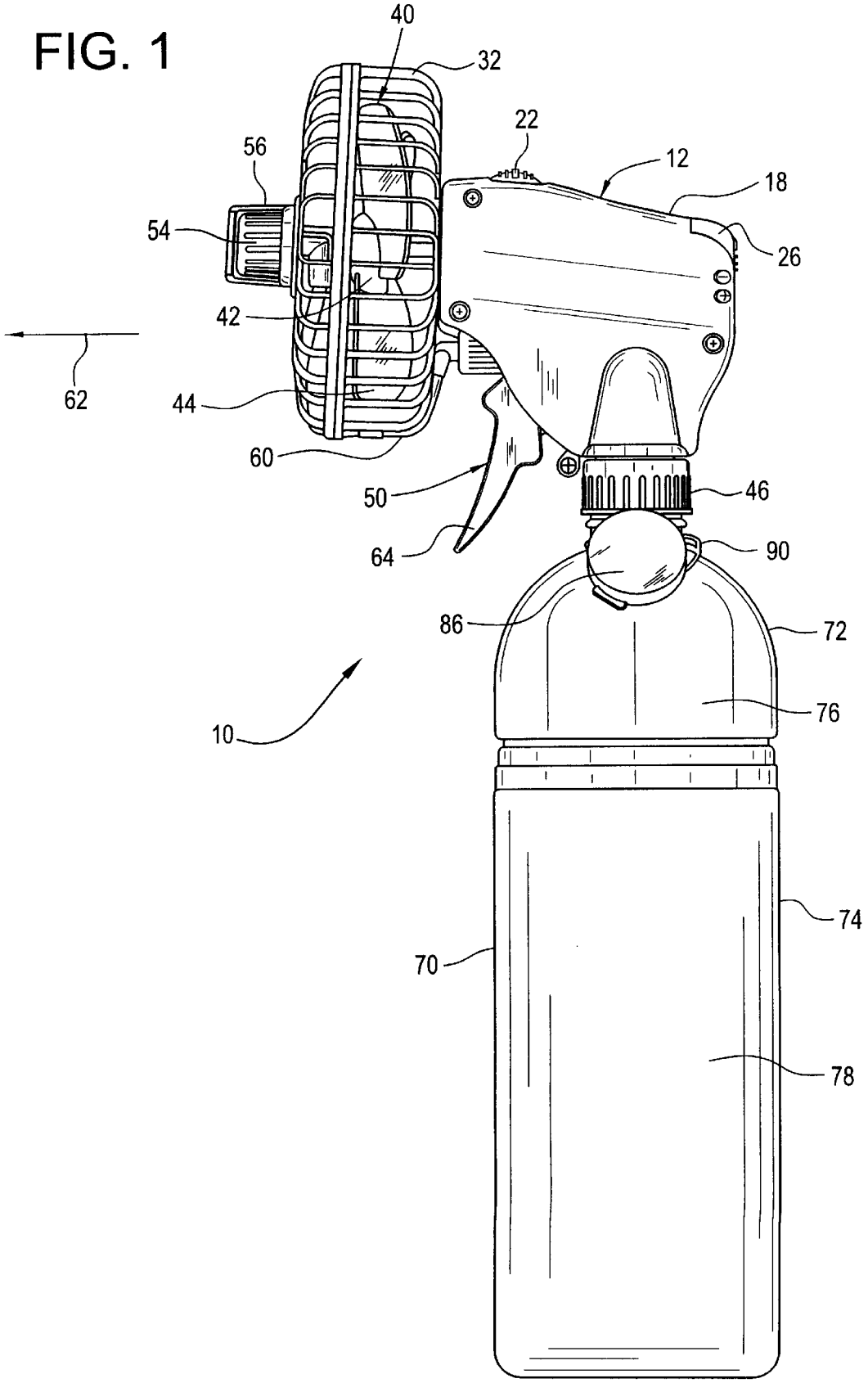
FIG. 1 is a perspective view of a portable spraying and drinking apparatus of a first embodiment.
Figure 2:
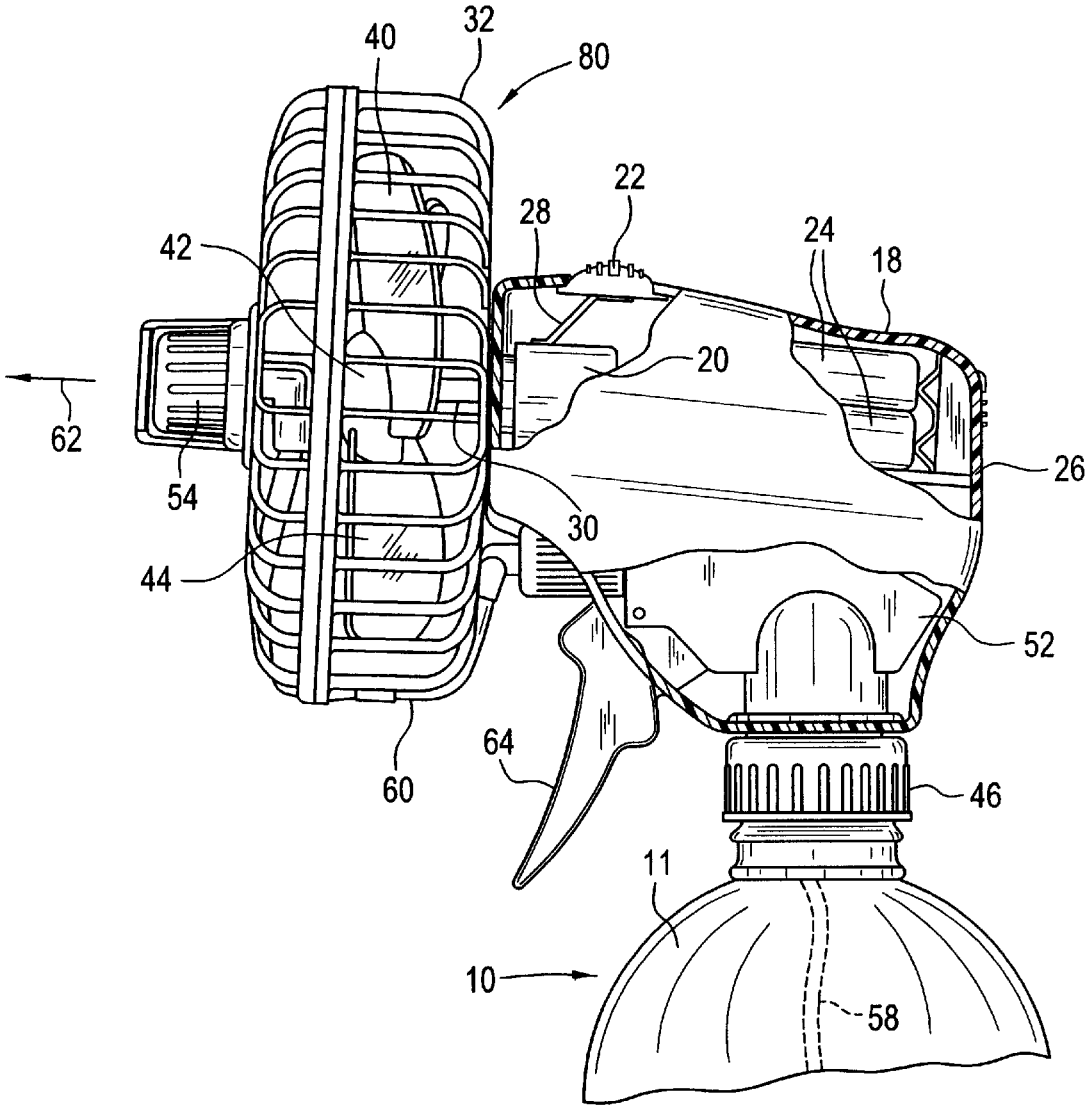
FIG. 2 is an enlarged, fragmentary elevational view of the apparatus with parts of a fan housing of the apparatus broken away.

Referring now to the drawings, a portable spraying and drinking apparatus for use as a personal cooling and drinking device is indicated generally at 10. (FIG. 1). The portable spraying and drinking apparatus comprises a fan 12, a spray assembly 50 and a liquid container 70 (all reference numerals designating their subjects generally). The fan 12 provides a cooling flow of air and facilitates the evaporation of liquid on the user's skin. As illustrated in FIG. 2, the fan 12 includes a housing 18 containing a motor 20, a switch 22, batteries 24, a battery access door 26, and wiring 28. When the switch 22 is moved to the "on" position, the switch completes an electrical circuit between the batteries 24 and the motor 20, thereby energizing the motor. A shaft 30, rotatably connected to the motor 20 and extending from an opening in the fan housing 18 is rotated by the motor. A shroud 32 mounted on the housing 18 encloses a fan blade assembly, generally indicated at 40. The fan blade assembly 40 is mounted on the shaft 30 for conjoint rotation with the shaft. The fan blade assembly 40 comprises a hub 42 and blades 44.

The spray assembly 50 is comprised of a spray head 52, a spray nozzle 54, a nozzle cage 56, a spray siphon tube 58, and a nozzle tube 60. (FIGS. 1 and 2). A spray nozzle 54 in the shape of a frustum of a cone is rotatably mounted on the exterior of the shroud 32 along the axis of the shaft 30, so that the spraying assembly 50 is capable of delivering atomized liquid into the center of an air stream 62 created by the fan blade assembly 40. The spray nozzle 54 is attached to the fan shroud 32 by the nozzle cage 56. The nozzle cage 56 allows the spray nozzle 54 to rotate about its axis, such that the user can rotate the nozzle and adjust the water flow and spray shape. The spray head 52 is fully integrated into the fan housing 18 and pumps liquid. The construction and operation of the spray head 52 is well known in the art. The spray head 52 draws water into the spray siphon tube 58, and delivers it through nozzle tube 60, and out the spray nozzle 54 in response to the pumping of a trigger 64. The nozzle tube 60 directs water from the spray head 52, around the bottom and up the front of the fan shroud 32 to the nozzle 54 so that the nozzle is located generally in the center of the shroud and the center of the air stream 62 generated by the fan 12.

Figure 3:
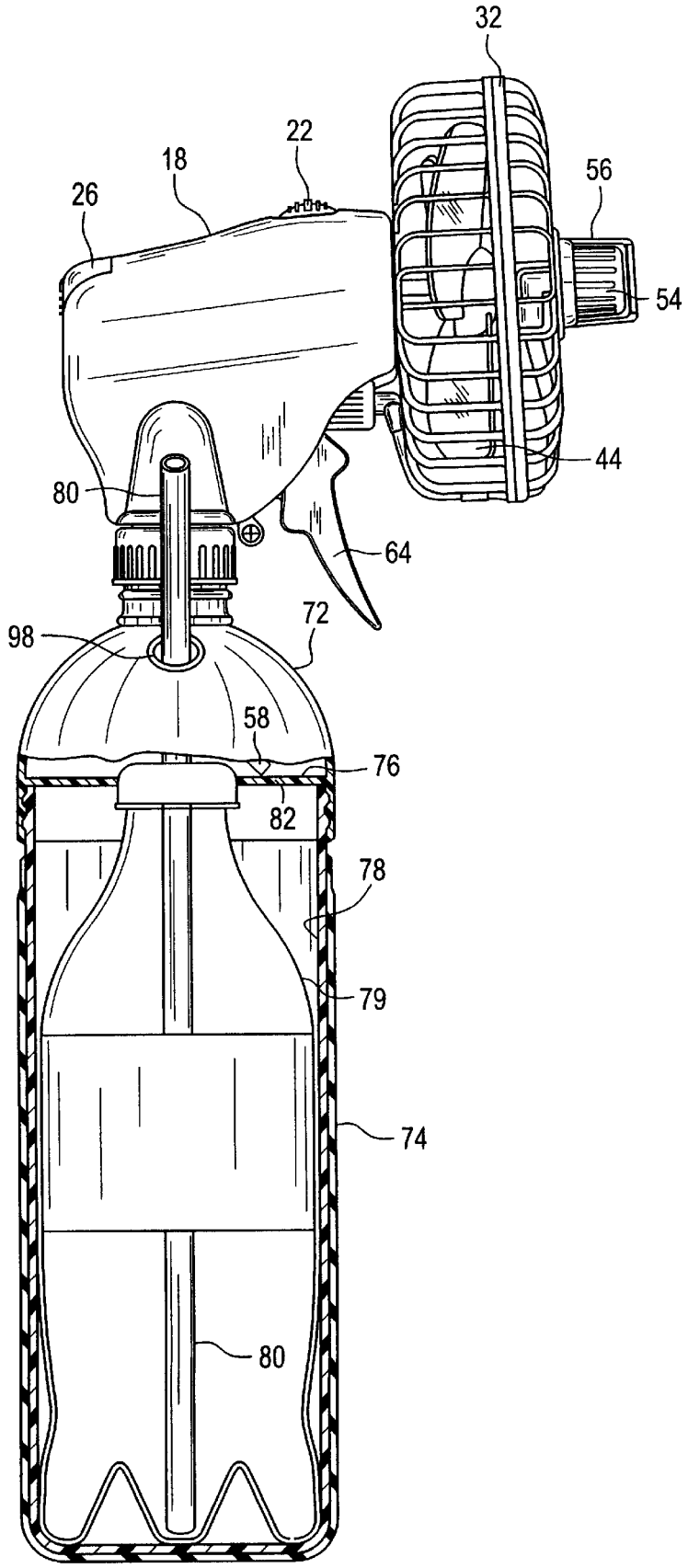
FIG. 3 is an elevational view of the apparatus with a portion of a liquid container of the apparatus broken away.
Figure 4:
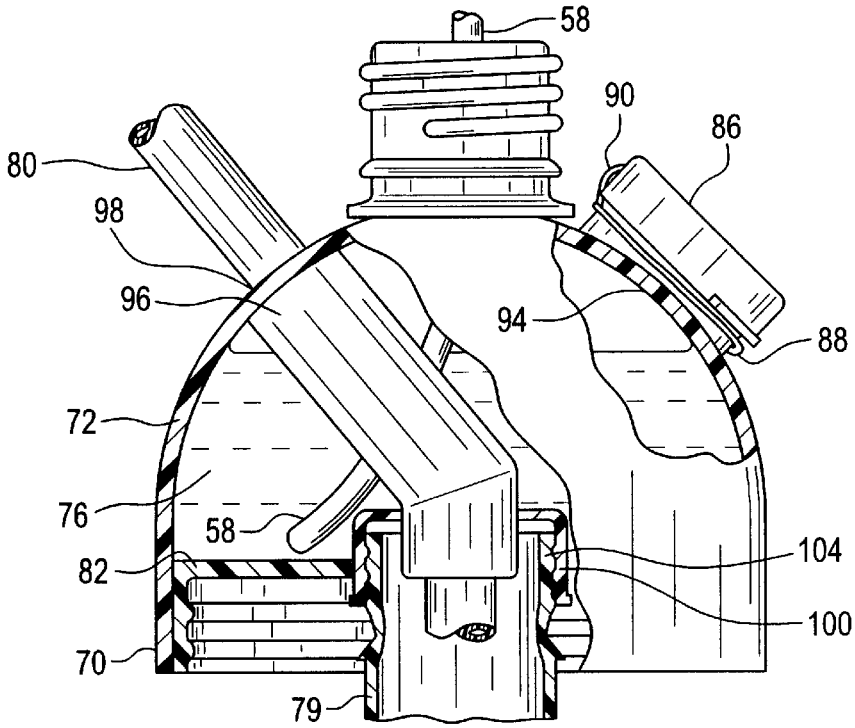
FIG. 4 is an enlarged, fragmentary view of an upper portion of the liquid container separated from a lower portion, with the fan housing and fan removed, and with parts broken away to show internal construction.
Figure 5:
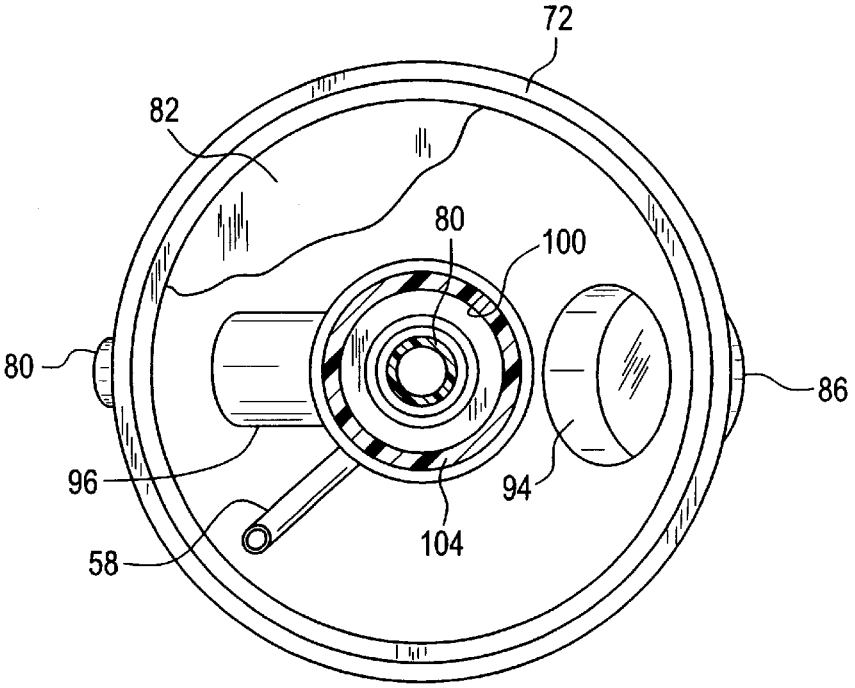
FIG. 5 is a bottom plan view of the upper portion of FIG. 4 with parts broken away to show details of construction.

The fan 12 and spray assembly 50 would be threadably attached to a container 70 of the apparatus 10 by a threaded neck ring 46. However, it is to be understood that the fan housing 18 may be integrally attached to the container 70 or formed as one piece with the container without departing from the scope of the resent invention. In the first embodiment, the container 70 includes two pieces, an upper dome 72 and a lower jacket 74. (FIGS. 1 and 3). When the dome 72 and the jacket 74 are threadably interconnected via their threaded portions at the top edge of the jacket and the bottom edge of the dome, the container 70 has two chambers. An upper chamber 76, completely within the dome 72, holds liquid for spraying through the spraying assembly 50. A lower chamber 78 encloses a pre-packaged beverage container 79 which is accessed for drinking through a straw 80. The upper chamber 76 is separated from the lower chamber 78 by an internal wall 82, arranged horizontally across the lower portion of the dome 72. The spray siphon tube 58 extends from the spray head 52, through the neck 84 of the container 70, and into the liquid held in the upper chamber 76. (FIGS. 3–5).

A removable filling cap 86 is releasably attached to the dome 72 and can be removed to expose a filling orifice 94 in the dome for filling the upper chamber 76 with liquid. The removable filling cap 86 is tethered to the dome by a ring 88 and a strap 90 so that the when the cap is removed, it is retained with the container 70. The ring 88 is slightly smaller than a lip (not shown) around the filling orifice 94, so that the ring 88, strap 90, and filling cap 86 will not separate from the container 70.

The dome 72 also includes an angled guide tube 96 which guides a drinking straw 80 through a drinking orifice 98 in the dome 72 and into the lower chamber 78. (FIGS. 4 and 5). The guide tube 96 is cylindrical in shape and is slightly larger than the drinking straw 80 so that the user can slide the straw into the container 70, through the dome 72 and internal wall 82, and into the pre-packaged beverage container 79. The guide tube 96 forms a seal with both the dome 72 and the internal wall 82 so that the liquid in the upper chamber 76 does not leak outside the container 70 or into the lower chamber 78. The guide tube 96 ends in the center of a threaded connector 100 defined in the internal wall 82. (FIG. 4). The threaded connector 100 is sized to receive the pre-packaged beverage container 79 (shown in the form of a conventional 20 ounce plastic soft drink bottle) which has an approximately one inch mouth 104. The threaded connector 100 is constructed to mate with the threads formed to receive the cap (not shown) of the beverage container 79 when it is packaged. The cap is removed prior to connection to the threaded connector. The jacket 74 can then be screwed into the dome 72 to surround and insulate the beverage container 79. The pre-package beverage container 79 forms a drinking liquid compartment in the first embodiment. The jacket 74 may also form a drinking liquid compartment if no pre-package beverage container 79 is used.

Figure 6:
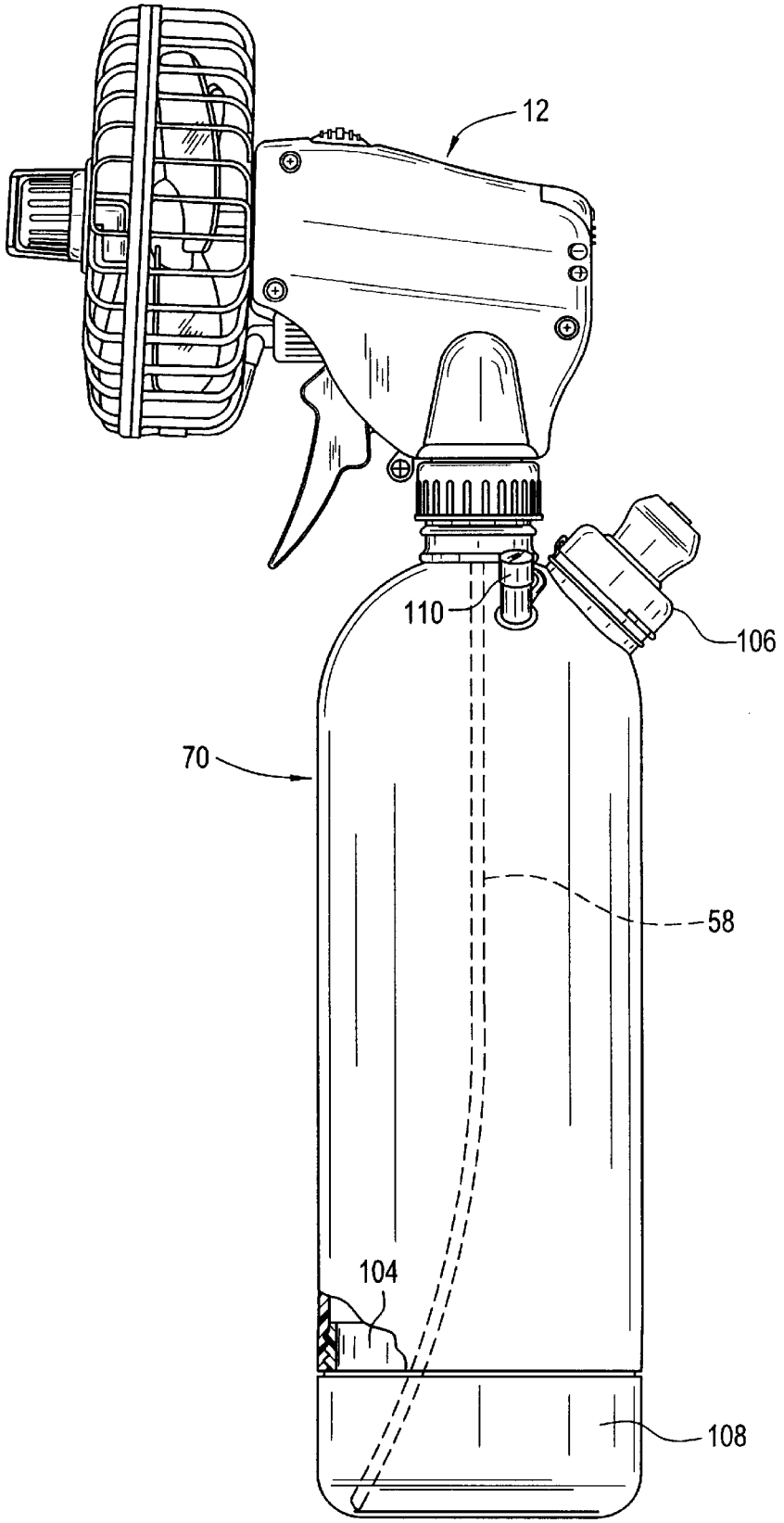
FIG. 6 is an elevational view of a portable spraying and drinking apparatus of a second embodiment.

In a second embodiment (FIG. 6), the liquid container 70 has only a single chamber 104 which holds liquid for both spraying and drinking. A pull up drinking cap 106 allows the user to drink from the container 70. The cap 106 is releasably attached by threaded connection to the container so that the cap can be removed to expose a larger opening (not shown) for filling the container 70. The bottom of the container 70 is a screw on cover 108 which can be removed from the container to expose a much larger opening for putting ice into the container. The cover 108 is constructed for sealing connection with the remainder of the container 70 when it is screwed onto the bottom of the container. The container 70 including the cover 108 preferably incorporate a thermally insulating material to keep the liquid inside the container cold. A pull off plug 110 on the container 70 is also provided so that a straw can be inserted into the container for drinking the liquid.

Figure 7:
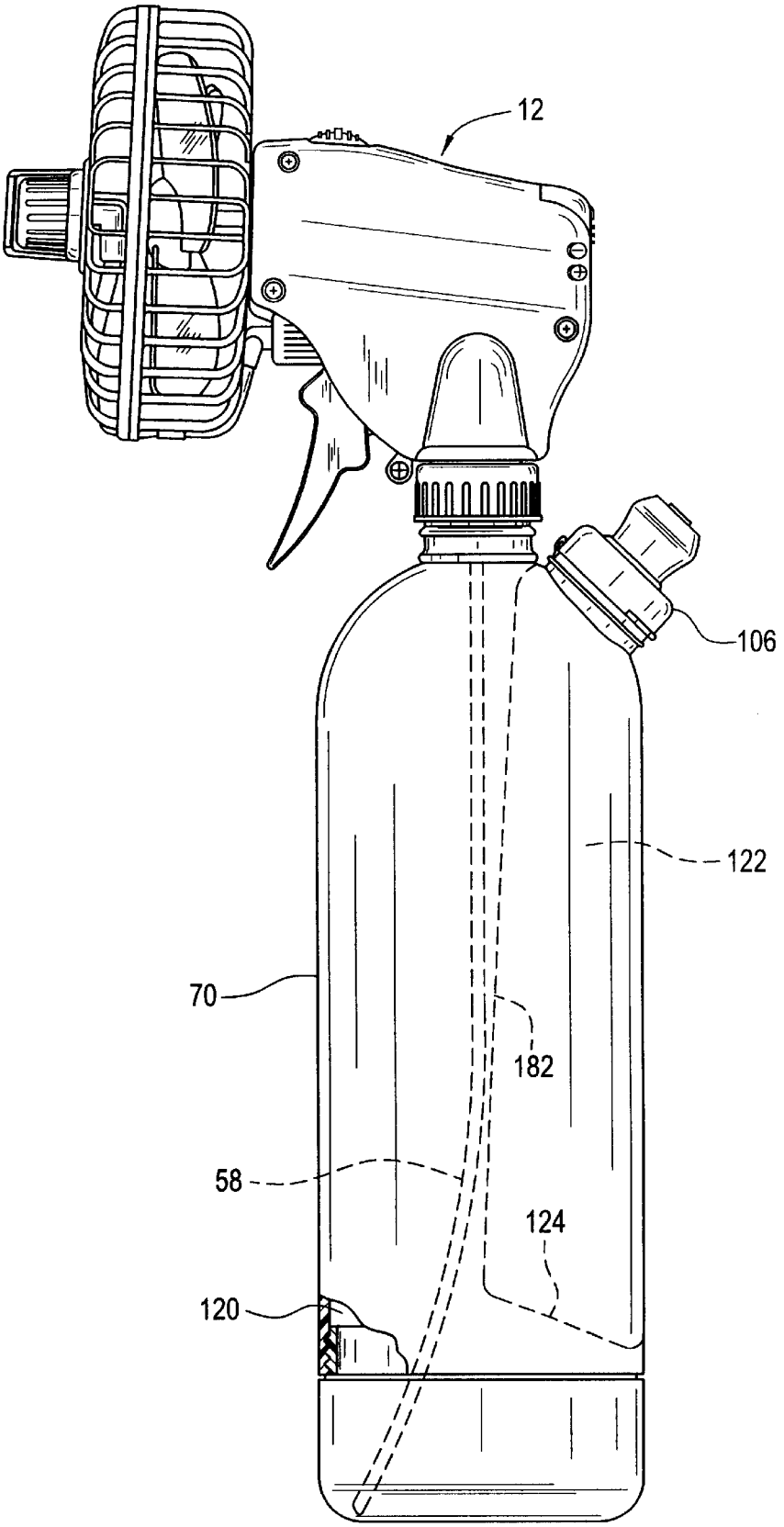
FIG. 7 is an elevational view of apparatus of a third embodiment having separate internal compartments for drinking and spraying liquids.

A third embodiment is closely similar to the second embodiment except that the liquid container 70 is divided internally into two compartments, the spraying liquid compartment 120 and the drinking liquid compartment 122. (FIG. 7). The drinking liquid compartment 122 is partitioned from the spraying liquid compartment 120 by means of a generally vertical internal wall 182, a bottom end wall 124, and the upper end of the container 70, entirely separating the drinking liquid compartment from the spraying liquid compartment, thereby preventing mixing of the two liquids. The vertical internal wall 182 is generally parallel to the sides of the container 70. The drinking liquid compartment 122 is closed at the top by the top of the container 70 and at the bottom by the bottom end wall 124. The spraying liquid compartment 120 includes the remaining internal space occupied by the liquid container 70.

Figure 8:
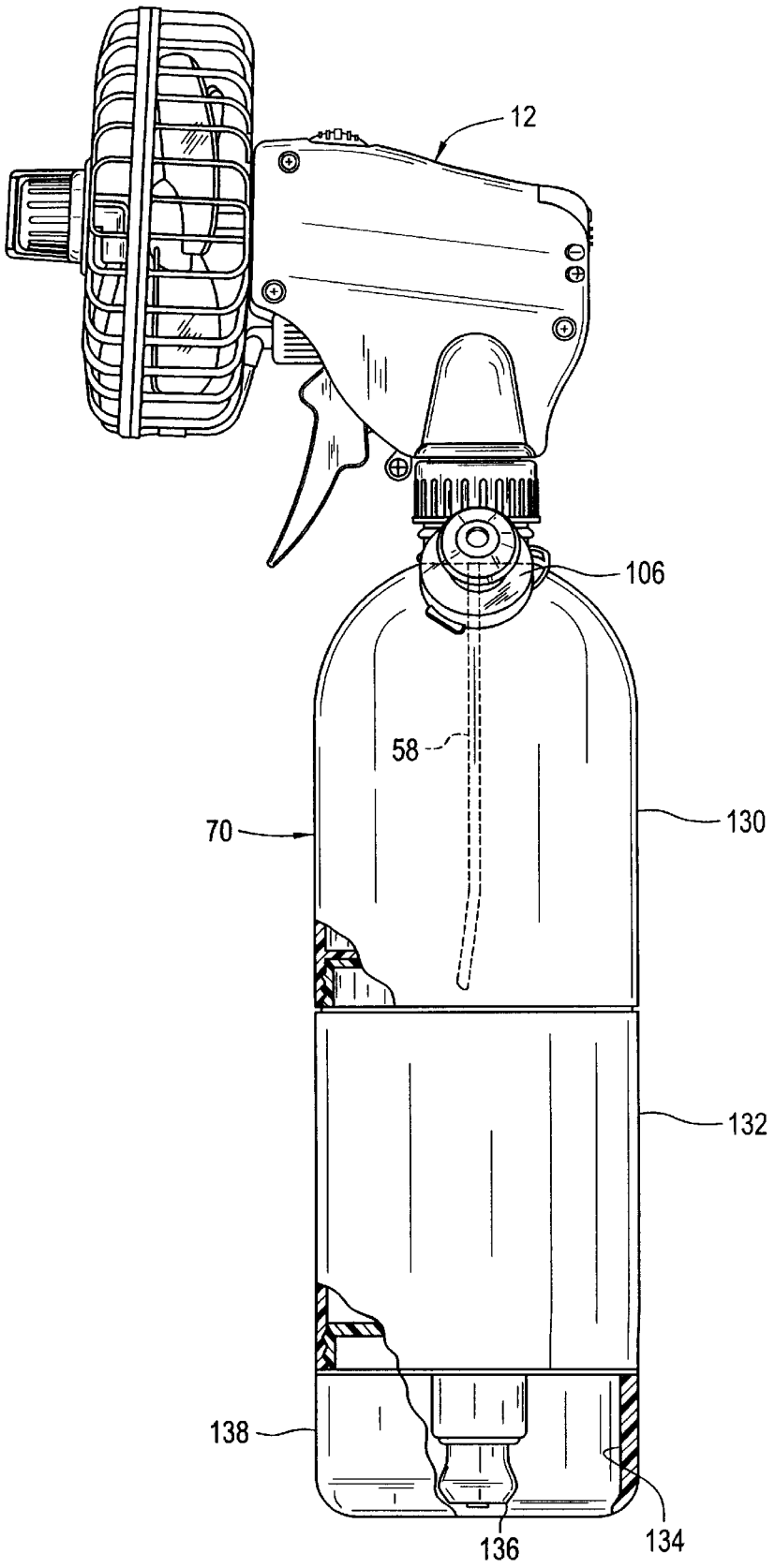
FIG. 8 is an elevational view of a fourth embodiment of the portable spraying and drinking apparatus with a "thread-on" drinking liquid compartment.

In a fourth embodiment (FIG. 8), the liquid container 70 is again divided into upper and lower compartments 130, 132. The upper compartment 130 functions as both a spraying liquid compartment and a drinking liquid compartment. In this regard, it will be noted that the spray siphon tube 58 terminates within the upper compartment 130. In addition, the pull up cap 106 is in fluid communication with the upper compartment 130 for drinking and for refilling that compartment only. The lower compartment 132 holds liquid for drinking only.

The upper compartment 130 is constructed with internal threads in a bottom recess and the lower compartment 132 has external threads on an upper flange for threaded interconnection. The lower compartment 132 may be unscrewed and removed from the upper compartment 130 so that it can be used as a drink container apart from the rest of the apparatus. It is to be understood that other types of connections between the compartments 130, 132 are envisioned, such as a snap on connection.

The lower compartment 132 further contains a bottom recess 134 in the bottom where a pull top drinking cap 136 is threadably received on a threaded liquid container opening (not shown). The bottom recess 134 is of an adequate depth to ensure the pull top drinking cap 136 does not protrude beyond the bottom plane of the container 70. The recess 134 allows the container 70 to rest in a stable manner on a flat surface. A cover 138, which defines the recess 134 is attached by threads to the remainder of the lower compartment 132. Removal of the cover 138 permits access to the interior of the lower compartment 132 for re-filling and to add ice.

Figure 9:
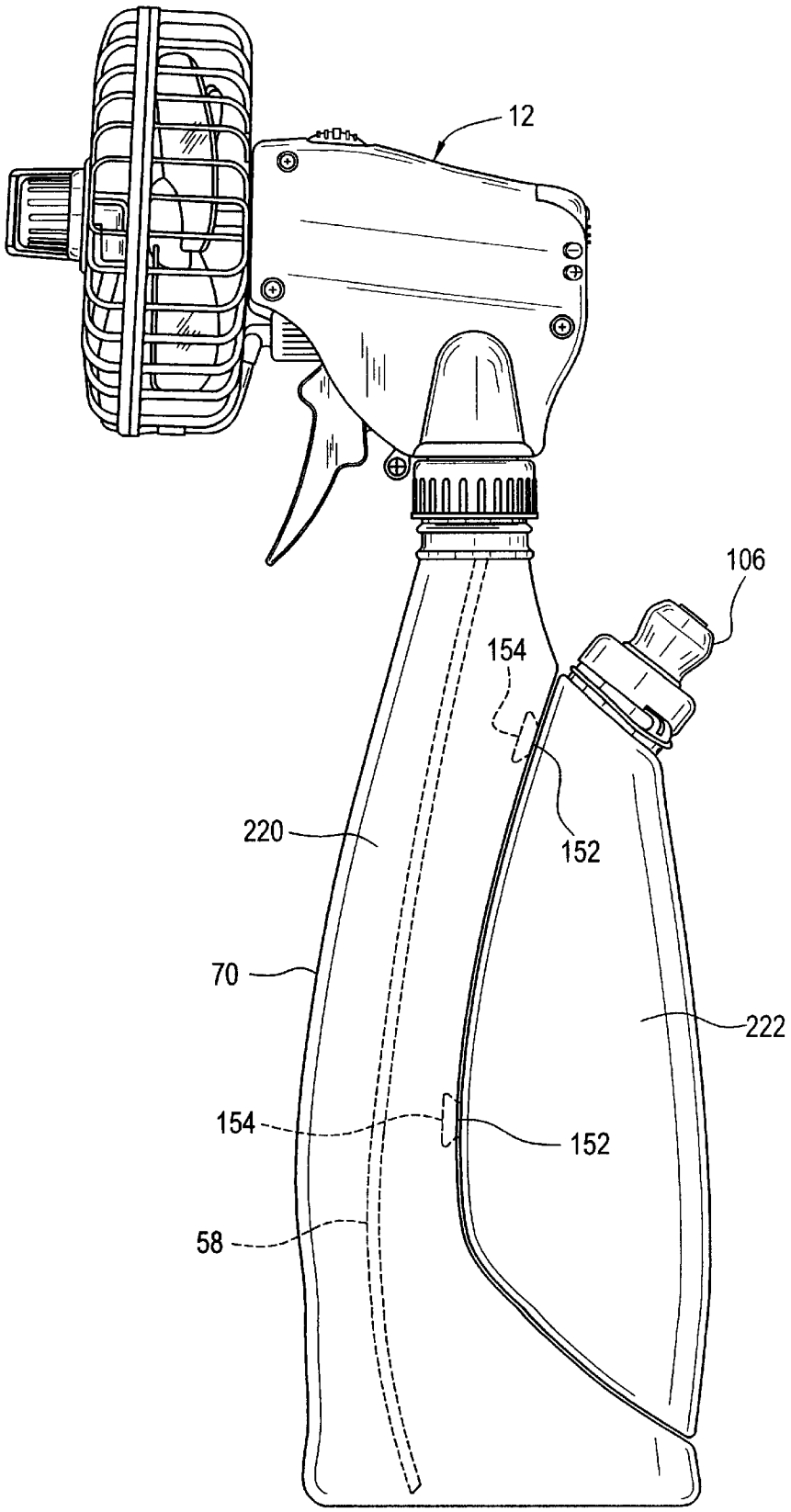
FIG. 9 is an elevational view of a fifth embodiment of the portable spraying and drinking apparatus with a "snap-on" drinking liquid compartment.

In a fifth embodiment (FIG. 9), the liquid container 70 is again separated into two compartments, the spraying liquid compartment 220 and the drinking liquid compartment 222. The releasable and replaceable drinking liquid compartment 222 fits into a complementary recess 151 formed on the spraying liquid compartment 220. Both compartments 220, 222 fit closely together to form a continuous, visually appealing surface. The drinking liquid compartment 222 is snapped and held in place by an interference fit created between a plurality of resilient tabs 152 formed on the drinking liquid compartment and a plurality of corresponding seats 154 formed in the spraying liquid compartment 220. The pull top drinking cap 106 is removably, threadably connected to a threaded liquid container opening of the drinking liquid compartment 222 and is engaged by lifting up the cap. The spraying siphon tube 58 is located in the spraying liquid compartment 220 for receiving liquid to be sprayed onto the user.

Figure 10:
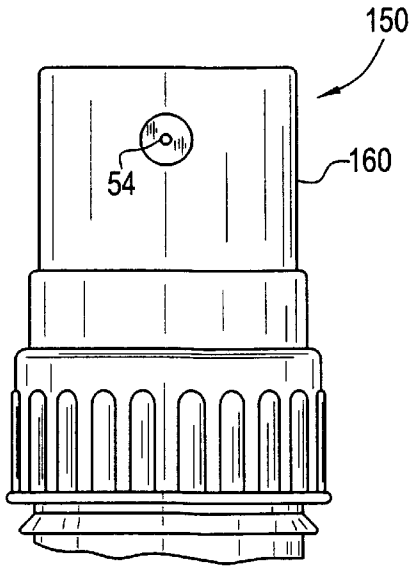
FIG. 10 is a fragmentary, elevational view of a spraying device of the portable spraying and drinking apparatus forming a sixth embodiment of the present invention.

In a sixth embodiment (FIG. 10), the fan 12 and liquid spraying device 50 are replaced by a spraying assembly generally indicated at 150. The spraying assembly is constructed to spray water when a spray button 160 on the top of the spraying assembly is repeatedly depressed. (FIG. 10). The vertical motion of the button 160 draws liquid from the liquid container 70 into a spray siphon tube 58, and ejects it from the nozzle 54 which is incorporated into the button 160. This alternate construction of the liquid spraying assembly 150 is also well known in the art. It is to be understood that the spray button 160 may be used with all the previously described embodiments in place of the fan 12 and the spray assembly 50, as well as in other combinations.

Figure 11:
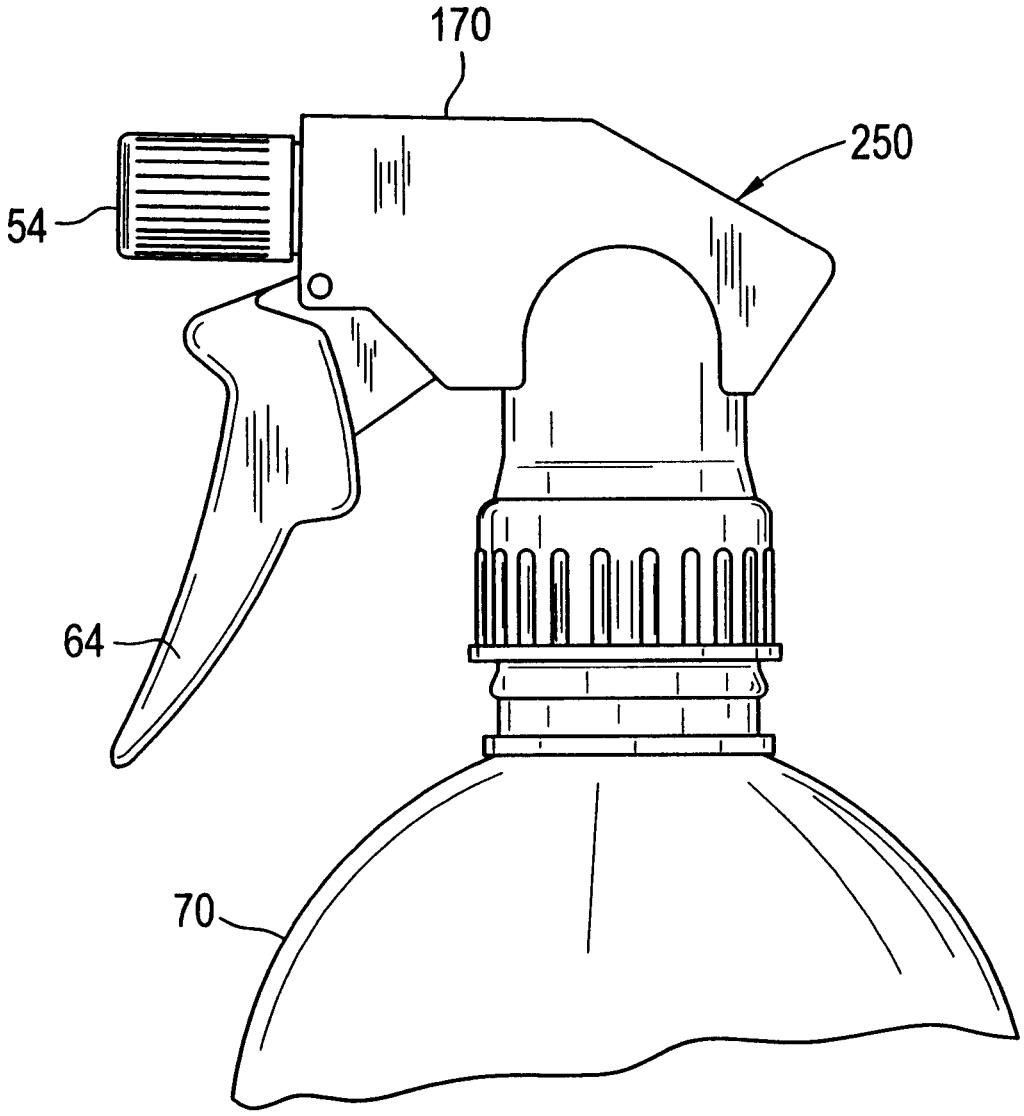
FIG. 11 is an elevational view of a spraying device of the portable spraying and drinking apparatus forming a seventh embodiment of the present invention.

A seventh embodiment (FIG. 11) is closely similar to the sixth embodiment shown in FIG. 10. However, a different form of liquid spraying assembly (indicated generally at 250) having a lever actuator 64 is used in place of the push button 160. The construction and operation of the spray assembly 250 is well known to those of ordinary skill in the art.

Figure 13:
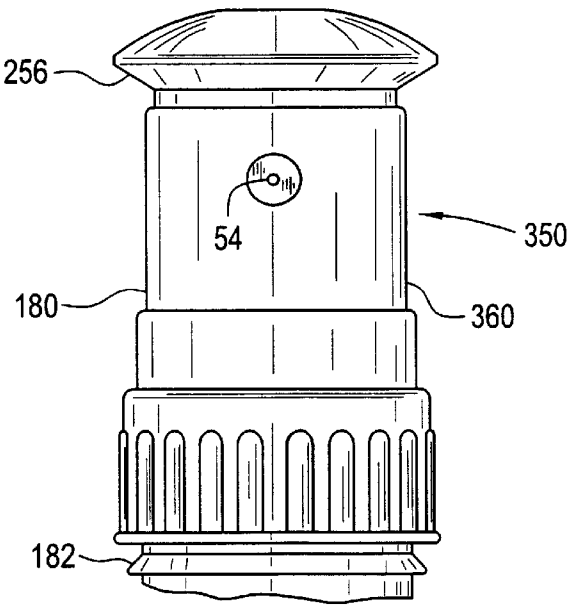
FIG. 13 is the elevational view of the spraying and drinking device of FIG. 12 showing a pull top in a raised position.
Figure 12:
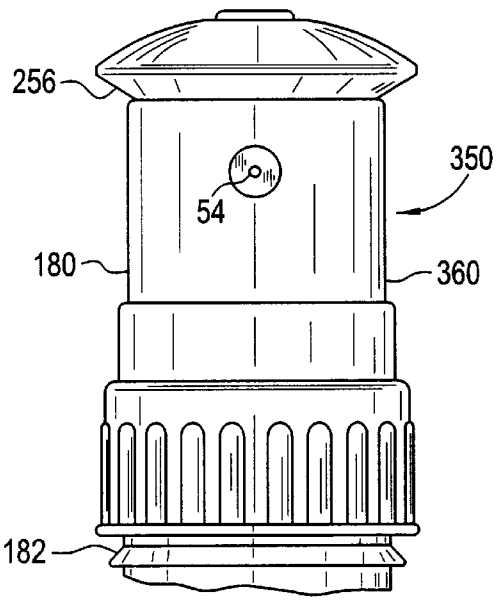
FIG. 12 is an elevational view of a combination spraying and drinking device of the portable spraying and drinking apparatus forming an eighth embodiment of the present invention.
Figure 13A:
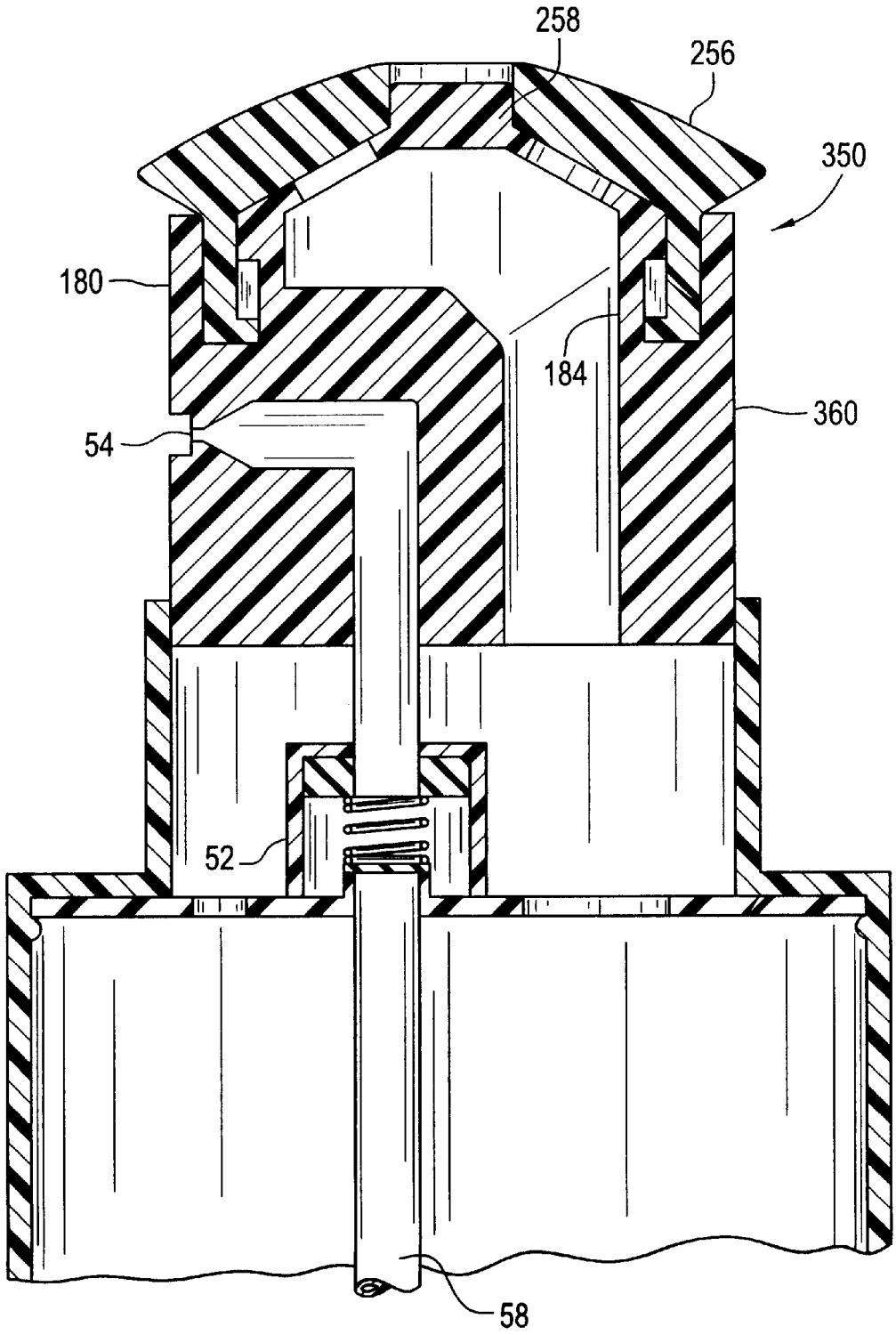
FIG. 13A is a sectional view of the spraying and drinking device of FIG. 12.

In an eighth embodiment (FIGS. 12, 13 and 13A), the liquid spray assembly 350 is a modification of the push button 160 of the sixth embodiment incorporating a pull top for drinking into a single combination cap 180. The combination cap 180 is threadably received on the threaded neck 182 of the container 70. As in the sixth embodiment, depressing the spray button 360 causes liquid to be pumped from the liquid container 70, through a spray siphon tube 58, and out the spray button nozzle 54. In addition, by lifting the pull top 256 up from the combination cap 180, the liquid drinking device is engaged and liquid will now pass from the liquid container 70 and through a passage 184 placed in the combination cap 180. (FIG. 13A). Once the pull top 256 is pulled upward, the drinking device of this embodiment functions similarly to the pull top drinking cap discussed previously. The pull top 256 is slidably received in an annular cavity in the spray button 360 for movement up and down relative to the spray button. Raising the pull top 256 lifts it off of a seat 258 formed in the button 360 at the end of the passage 184. Lowering the pull top 256 causes a friction fit between the top and the seat 258 which seals the passage.

Figure 14:
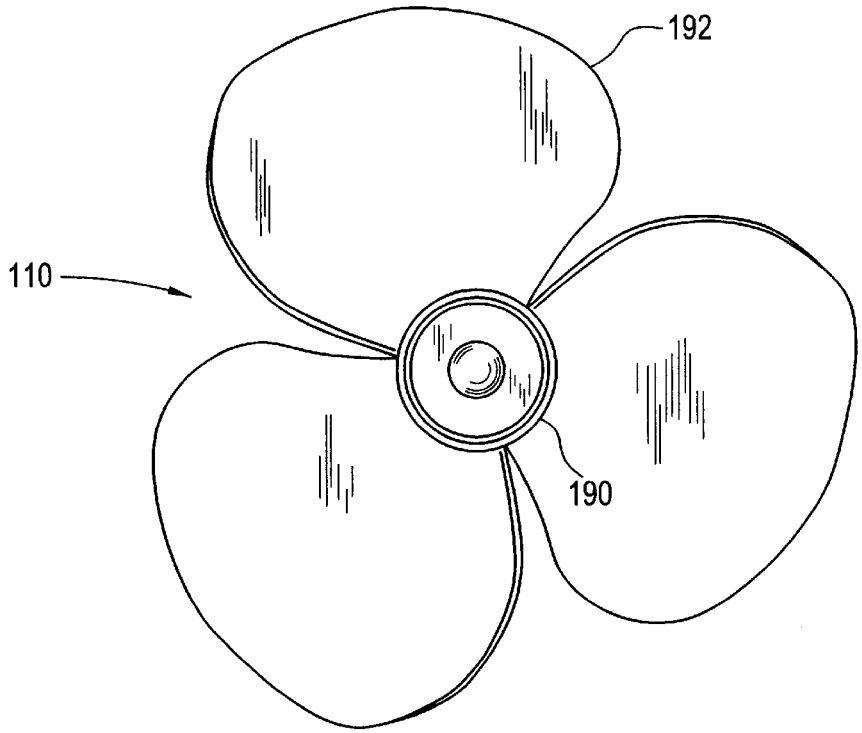
FIG. 14 is a front elevational view of a fan blade assembly.
Figure 15:
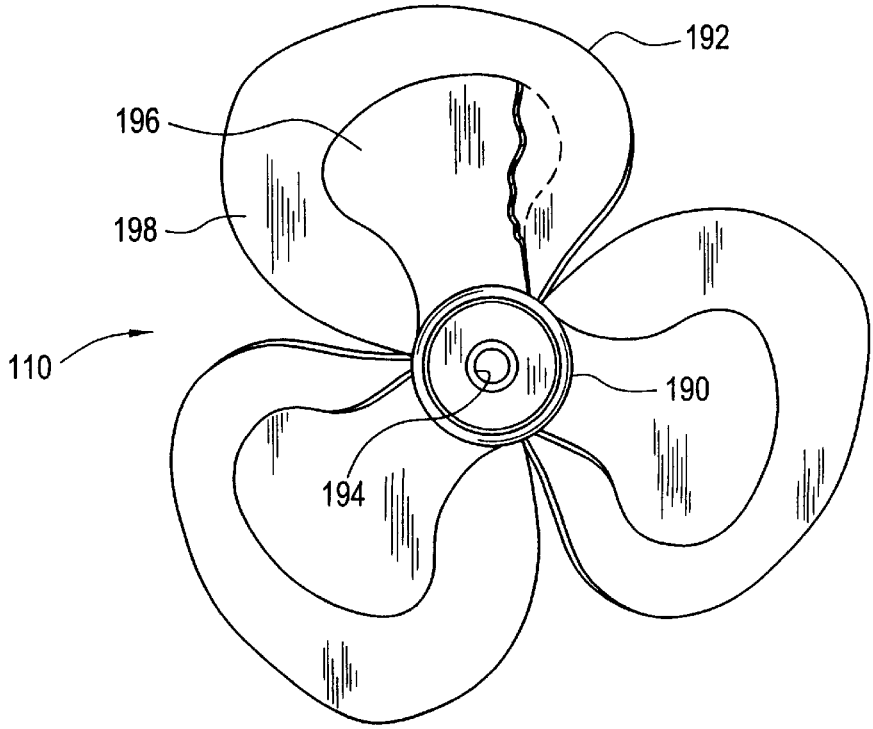
FIG. 15 is a rear elevational view of the fan blade assembly.
Figure 16:
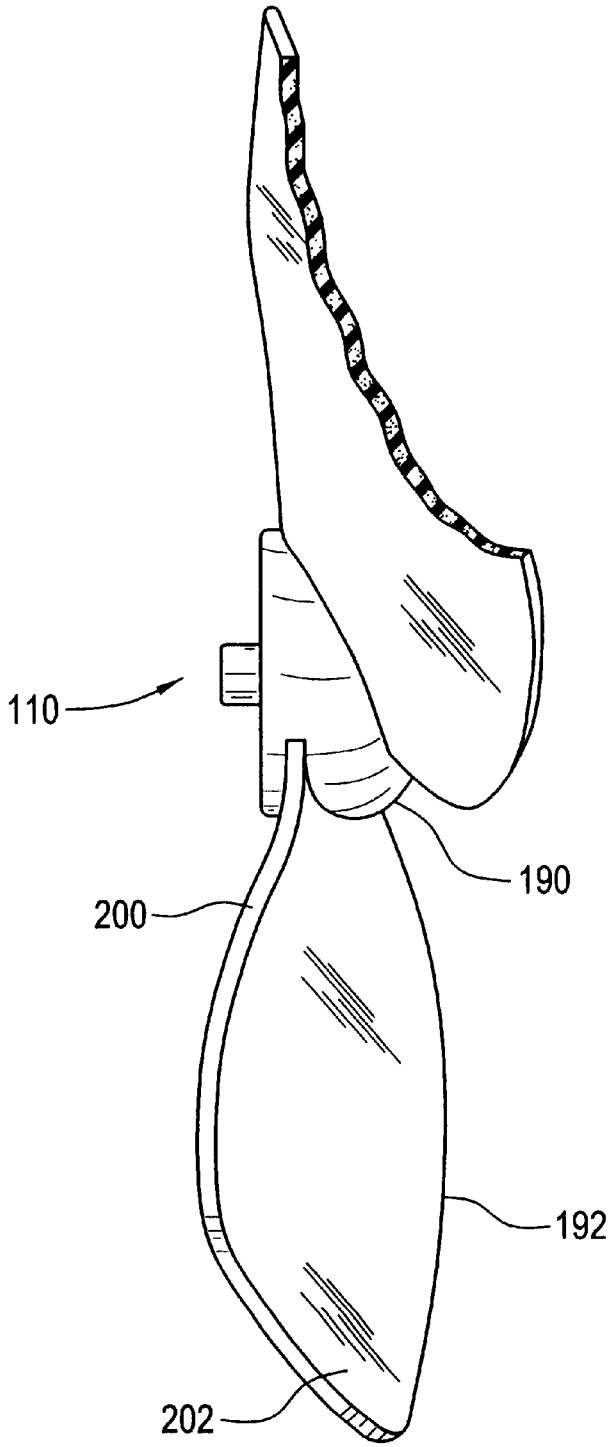
FIG. 16 is a side elevational and partial sectional view of another embodiment of the fan blade assembly.

Referring now to FIGS. 14–16, a fan blade assembly for use as a personal cooling device is indicated generally at 110. The fan blade assembly 110 comprises a hub 190 and a plurality of airfoil shaped blades 192 extending radially outward from the hub. The hub 190 is cylindrically formed from a rigid material having a cylindrical bore 194 located along its cylindrical axis for fixedly receiving a rotatable shaft 30 of a motor 20 (not shown). The rotatable shaft 30 may be rotated by any means and is fixedly held in the hub 190 such that the rotating shaft 30, hub 190, and fan blades 192 rotate together, creating an air stream 62.

The fan blades 192 comprise a rigid inner blade 196 attached to a more flexible and resilient outer blade 198. The face of the outer blade 198, larger than the inner blade 196, is fixedly attached to the face of the inner blade. The rigid inner blade 196 is fixedly attached to the hub 190. When the hub 190 rotates about its cylindrical axis, the rigid inner blade 196 simultaneously rotates and subsequently causes rotation of the outer blade 198. The inner blade 196 must be sufficiently rigid to withstand the rotational forces exerted by the hub 190 as well as the force due to air resistance exerted against it as it pushes the outer blade 198 through the air so as to substantially maintain the shape of the blade 192. The outer blade 198 must be sufficiently flexible and resilient such that an object, such as human skin, coming in contact with the blade 192 will not be damaged. In combination, the rigid backing blade 196 and soft outer blade 198 allow the size of the overall fan blade 192 to increase, while retaining the blade shape. Before the current invention, it is believed that soft blades were limited in size because they would deform unacceptably during rotation. The outer blade 198 edge may also be beveled or rounded to increase airflow.

Each fan blade 192 may, in another embodiment, be unitary construction and formed from a resilient closed cell foam of variable density. (FIG. 16). (e.g., Softlite Ionomer Foam, available from the Gilman Corporation of Gilman, Conn.). The blade 192 is constructed to have a higher density near the hub 190 and a proportionally lower density as the blade extends radially outward from the hub 190 toward the blade edge. The higher density portion 200 of the blade 192 near the hub 190 results in a correspondingly more rigid blade near the center, and the lower density portion 202 nearer the peripheral edge portions of the blade define a more flexible and resilient outer portion. The higher density portion 200 near the hub 190 allows the blade 192 to withstand the rotational force exerted by the rotating hub 190 while the lower density portion 202 allows the fan blade 192 to be soft, flexible, and non-dangerous during contact with human skin or other objects. The variable density foam permits the size of the overall fan blade 192 to increase to much larger sizes than previous soft bladed fans, while maintaining blade shape during rotation. The edge of the blade 192 may also be beveled or rounded.

In employing any embodiment, it is understood that a fan motor 20 (not shown), a shaft 30 (not shown), a fan housing 18 (not shown), a fan shroud 32 enclosing the blade assembly (not shown), a fan stand (not shown) or any other known fan component or apparatus may be added to the disclosed embodiments without departing from the scope of the invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Portable spraying and drinking apparatus for personal cooling and hydration, the portable spraying and drinking apparatus comprising:

a liquid container having a depressible button cap mounted thereon;

a liquid spraying device, for pumping liquid from the container and spraying the liquid, the liquid spraying device comprising a pump in a first passage extending through said depressible button cap whereby said button cap is cyclically depressible to actuate the pump for delivering liquid from the liquid container in a spray; and a liquid drinking device, for removing liquid from the container for consumption by the user, the liquid drinking device comprising a second passage within the depressible button cap and a plug movable between a sealed configuration in which the second passage in the cap is sealed and an unsealed configuration in which the second passage is unsealed, the liquid spraying and drinking devices being incorporated into a single unit capable of being held in one hand.

* * * * *